US008287062B2

(12) United States Patent
Nash et al.

(10) Patent No.: US 8,287,062 B2
(45) Date of Patent: Oct. 16, 2012

(54) SHELF FOR AN APPLIANCE

(75) Inventors: Jonathan Nash, Lagrange, KY (US); Donald Breit, Louisville, KY (US)

(73) Assignee: General Electric Company, Schenectady, NY (US)

( * ) Notice: Subject to any disclaimer, the term of this patent is extended or adjusted under 35 U.S.C. 154(b) by 461 days.

(21) Appl. No.: 12/603,320

(22) Filed: Oct. 21, 2009

(65) Prior Publication Data

US 2011/0089800 A1 Apr. 21, 2011

(51) Int. Cl.
*A47B 96/04* (2006.01)

(52) U.S. Cl. ..... 312/408; 108/108

(58) Field of Classification Search ..... 312/408, 312/351, 404, 402; 108/106–108; 62/302, 62/465; 211/134, 186, 187, 153, 151
See application file for complete search history.

(56) References Cited

U.S. PATENT DOCUMENTS

| | | | | |
|---|---|---|---|---|
| 3,986,163 | A | 10/1976 | Elliott | |
| 4,365,562 | A | 12/1982 | Webb | |
| 4,691,887 | A | 9/1987 | Bessinger | |
| 4,729,613 | A | 3/1988 | Tromble et al. | |
| 4,736,997 | A | 4/1988 | Besore | |
| 4,934,541 | A | 6/1990 | Bussan et al. | |
| 5,273,354 | A | 12/1993 | Herrmann | |
| 5,340,209 | A | 8/1994 | Kolbe et al. | |
| 5,362,145 | A | 11/1994 | Herrmann | |
| 5,403,084 | A | 4/1995 | Kane | |
| 5,429,433 | A | 7/1995 | Bird | |
| 5,441,338 | A | 8/1995 | Kane | |
| 5,516,204 | A | 5/1996 | Calvert | |
| 5,524,981 | A | 6/1996 | Herrmann et al. | |
| 5,540,493 | A | 7/1996 | Kane | |
| 5,735,589 | A | 4/1998 | Herrmann | |
| 5,813,741 | A | 9/1998 | Fish | |
| 6,045,101 | A | 4/2000 | Goyette | |
| 6,422,673 | B1 | 7/2002 | Bienick | |
| 6,488,347 | B1 | 12/2002 | Bienick | |
| 6,679,573 | B2 | 1/2004 | Bienick | |
| 6,729,704 | B2 | 5/2004 | Ames | |
| 6,811,045 | B1 | 11/2004 | Masker | |
| 6,851,776 | B2 | 2/2005 | Bienick | |
| 6,871,923 | B2 | 3/2005 | Dietz | |
| 7,270,385 | B2 | 9/2007 | Mathur et al. | |
| 7,306,304 | B2 | 12/2007 | Jang | |
| 7,731,316 | B2 * | 6/2010 | Wing | 312/408 |
| 2004/0036391 | A1 | 2/2004 | Vardon | |
| 2005/0218767 | A1 | 10/2005 | Jeong et al. | |

(Continued)

OTHER PUBLICATIONS

U.S. Appl. No. 12/621,301, filed Nov. 18, 2009, Jonathan Nash, et al.

*Primary Examiner* — Janet M Wilkens
(74) *Attorney, Agent, or Firm* — Global Patent Operation; Douglas D. Zhang

(57) ABSTRACT

A spill proof shelf, a refrigerator using the same and a method for assembling a shelf are disclosed. The shelf has a frame, which has a peripheral frame portion for defining a central opening. The shelf further has a plate supported by the peripheral frame portion for providing a containment region in cooperation with the opening. The shelf further has a bracket mountable to the frame. The shelf further has a pivotable tab formed in the peripheral frame portion, which pivots to engage the plate upon mounting of the bracket to the frame.

29 Claims, 4 Drawing Sheets

U.S. PATENT DOCUMENTS

2005/0258725 A1* 11/2005 Jang ..... 312/408
2006/0145577 A1* 7/2006 Daley et al. ..... 312/408
2006/0162373 A1* 7/2006 McMillin et al. ..... 62/440
2006/0254481 A1* 11/2006 Lee et al. ..... 108/108
2007/0046160 A1 3/2007 Egan
2007/0284985 A1* 12/2007 Wing ..... 312/408
2010/0052491 A1* 3/2010 Vardon ..... 312/408
2010/0181884 A1 7/2010 De La Garza et al.
2011/0089800 A1 4/2011 Nash et al.
2011/0115356 A1* 5/2011 Nash et al. ..... 312/408

* cited by examiner

SHELF FOR AN APPLIANCE

CROSS-REFERENCE TO RELATED APPLICATIONS

The present application relates to the U.S. patent application Ser. No. 12/621,301, entitled SHELF FOR AN APPLIANCE, filed on Nov. 18, 2009.

BACKGROUND OF THE INVENTION

The present invention relates generally to shelf assemblies for refrigerators and, more particularly, to spill proof refrigerator shelves which are flexible in replacement of the components of the shelves and economical in manufacture.

A refrigerator typically includes a number of shelves for the storage of food and beverage containers of a variety of shapes and sizes. As the containers are retrieved, returned and rearranged on the shelves, occasional leaks and spilling of food and liquid may occur. Extensive cleanup efforts are required since the spill will commonly flow down through the compartment, from shelf to shelf. Therefore, it is desirable to provide containment implements for the refrigerator to limit the area of such a spill.

Traditionally, a spill proof shelf of a refrigerator includes a frame, a glass pane supported by the frame, and may include one or more support brackets mating with the cant tracks of the refrigerator. The assembling of the brackets to the frame is typically accomplished by insert molding. When assembled by insert molding, the entire shelf has to be replaced in the event a failure of the shelf occurs. On the other hand, the failure mode of the shelf typically requires only the glass pane be replaced. Therefore, it is desirable to provide a refrigerator shelf which allows the glass pane be conveniently disassembled and replaced in case of shelf failure.

SUMMARY OF THE INVENTION

As described herein, the various exemplary embodiments of the present invention overcome one or more of the above or other disadvantages known in the art.

One aspect of the present invention relates to a shelf for a refrigerator. The shelf includes a frame, a plate supported by the frame and at least one bracket mountable to the frame. The frame includes a peripheral frame portion for defining a central opening. The plate is supported by the peripheral frame portion, for providing a containment region in cooperation with the central opening. The shelf further includes at least one pivotable tab associated with the peripheral frame portion. The pivotable tab is configured to engage at least a portion of the plate upon mounting of the at least one bracket to the frame.

Another aspect of the present invention relates to a refrigerator. The refrigerator includes at least one storing compartment and at least one shelf disposed in the compartment. The shelf includes a frame, a plate supported by the frame and at least one bracket mountable to the frame. The frame includes a peripheral frame portion for defining a central opening. The plate is supported by the peripheral frame portion, for providing a containment region in cooperation with the central opening. The shelf further includes at least one pivotable tab associated with the peripheral frame portion. The pivotable tab is configured to engage at least a portion of the plate upon mounting of the at least one bracket to the frame.

Another aspect of the present invention relates to a method of assembling a refrigerator shelf including a frame, a plate supported by the frame and a bracket mountable to the frame.

The method includes providing at least one pivotable tab associated with the frame. The method further includes supporting the plate by the frame and mounting the bracket to the frame. The method further includes pivoting the pivotable tab upon the mounting of the bracket to the frame, and locking the plate to the frame through the pivotable tab.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE EXEMPLARY EMBODIMENTS OF THE INVENTION

It is contemplated that the teaching of the description set forth below is applicable to all types of refrigeration appliances, including but not limited to household refrigerators. The present invention is therefore not intended to be limited to any particular refrigeration apparatus or configuration described in the exemplary embodiments of the present invention.

Figure 1:
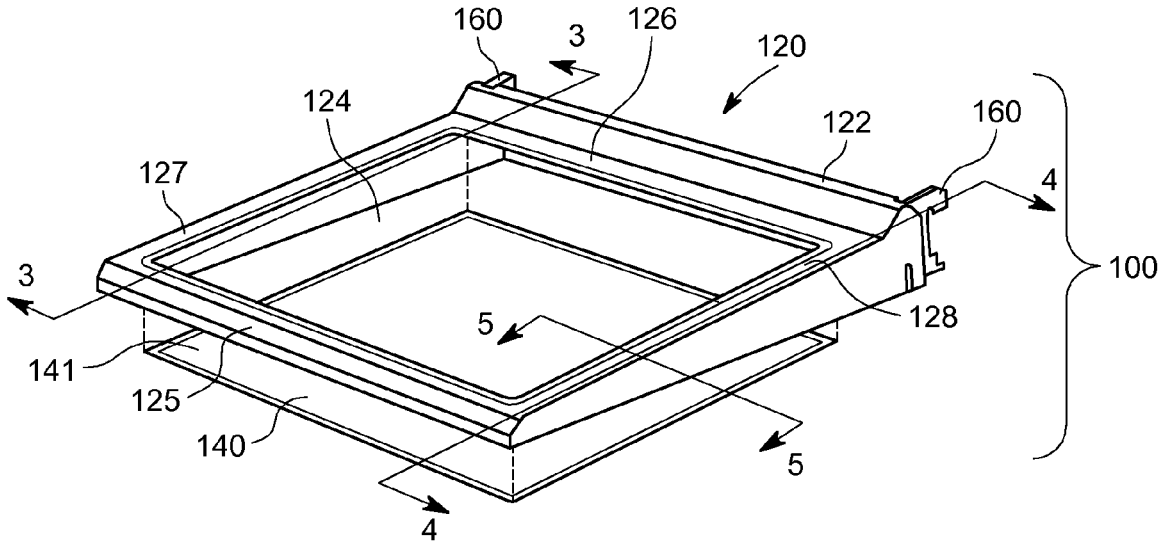
FIG. 1 is an exploded perspective view of a refrigerator shelf according to an exemplary embodiment of the present invention.

FIG. 1 illustrates an exploded perspective view of a refrigerator shelf 100 according to an exemplary embodiment of the present invention. The shelf 100 includes a frame 120, a plate 140 mountable to the frame 120 and supported by the frame 120, and a pair of support brackets 160 mountable to the frame 120. The shelf 100 is provided in a storing compartment of a refrigerator, for holding food or beverage containers.

The frame 120 can be fabricated from inexpensive, integrally molded plastic. The materials suitable for the frame 120 include, but are not limited to, talc filled polypropylene, acrylonitrile-butadiene-styrene (ABS), or High Impact Polystyrene (HIPS). Alternatively, the frame 120 can be assembled from a plurality of separate components having complementary mating structures. In the shown embodiment, the frame 120 is a one-piece, substantially rectangular frame, molded from homogeneous polymeric or copolymeric plastic material.

In the shown embodiment, the frame 120 includes a continuous peripheral frame portion 122 and a central opening 124 defined by the peripheral frame portion 122. The peripheral frame portion 122 includes a front frame portion 125, a rear frame portion 126, a left frame portion 127 and a right frame portion 128 connecting the front frame portion 125 and the rear frame portion 126 at the left side and right side of the frame 120, respectively. The opposite front frame portion 125 and rear frame portion 126 are substantially parallel to each other. The opposite left frame portion 127 and right frame portion 128 are substantially parallel to each other and perpendicular to the front frame portion 125 and rear frame portion 126. Accordingly, the peripheral frame portion 122 and the central opening 124 are substantially rectangular. The central opening 124, in cooperation with the plate 140, forms a containment region. In the event leaks and spilling of the food or beverage occurs, the spilled solid or liquid would be confined in the containment region.

The plate 140 is capable of supporting food or beverage containers on its upper surface 141. The plate 140 is substantially flat and rectangular, dimensioned to be substantially complementary to the frame 120 and the central opening 124 for forming the containment region. The plate 140 is releasably assembled to the frame 120 and further locked relative to the frame 120.

Figure 2:
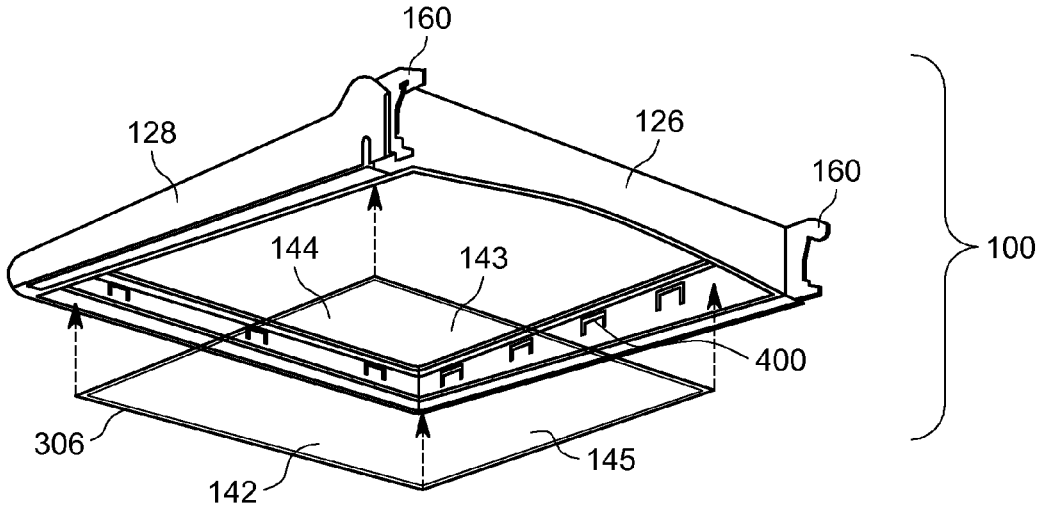
FIG. 2 is an exploded perspective view of the shelf in FIG. 1, with some components of the shelf removed.

FIG. 2 illustrates another exploded perspective view of the shelf 100, with parts of the shelf removed to better depict the structures of the frame 120, plate 140 and brackets 160. As shown, the plate 140 includes substantially parallel front edge 142 and rear edge 143, which are retained by the front frame portion 125 and rear frame portion 126 of the frame 120, respectively. The plate 140 further includes substantially parallel left edge 144 and right edge 145, which are retained by the left frame portion 127 and the right frame portion 128, respectively.

The plate 140 can be fabricated from a variety of suitable materials, including but not limited to, glass and plastics. In the shown embodiment, the plate 140 is a rectangular glass pane. The side portions of the frame 120 overlap the periphery of the upper surface 141. However, it should be understood by a person of ordinary skill in the art, that the plate 140 can assume different shapes and profiles, depending on the specific design of the refrigerator.

The pair of brackets 160 are releasably mounted to the frame 120, optionally through a snap fit. The brackets 160 can be fabricated from a variety of suitable materials, including but not limited to, steel. Furthermore, the number, position and configuration of the brackets can be changed depending on the specific design of the refrigerator.

Figure 3:
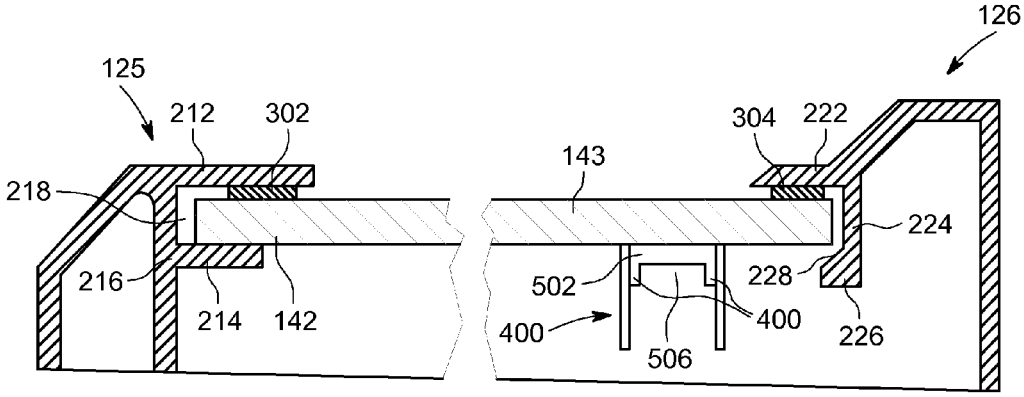
FIG. 3 is an enlarged, partial, cross section view of the shelf along Lines 3-3 in FIG. 1.

FIG. 3 is cross section view of the shelf 100 along Lines 3-3 in FIG. 1, illustrating the assembling of the plate 140 to the frame 120. The front frame portion 125 of the frame 120 includes an upper wall 212 and an opposite lower wall 214, connected by a middle wall 216. The upper wall 212, lower wall 214 and the middle wall 216 together define a receiving slot 218. The receiving slot 218 is configured to retain the front edge 142 of the plate 140. The rear frame portion 126 includes an upper wall 222 and a side wall 224 depending from the upper wall 222. At the lower end of the side wall 224 is provided an abutment 226 extending inwardly from the side wall 224. The abutment 226 has a slanted surface 228 for engaging the rear edge 143 of the plate 140.

During the process of mounting the plate 140 to the frame 120, the front edge 142 of the plate 140 is first placed into the receiving slot 218. Next, due to a space maintained between the middle wall 216 and the front edge 142 of the plate 140, the plate 140 can be slightly moved laterally to allow the rear edge 143 of the plate 140 to pass the abutment 226 and further be placed into the space between the upper wall 222 and the abutment 226. Alternatively or in addition, the abutment 226 can be slightly deformed to allow the rear edge 143 to pass the abutment 226 and further be placed into the space between the upper wall 222 and the abutment 226. Subsequently, the rear edge 143 of the plate 140 is lowered to engage the slanted surface 228 of the abutment 226. Accordingly, the front edge 142 and the rear edge 143 of the plate 140 are carried by the front frame portion 125 and the rear frame portion 126, respectively.

A seal 302 is provided between the upper wall 212 of the front frame portion 125 and plate 140. Similarly, a seal 304 is provided between the upper wall 222 of the rear frame portion 126 and the plate 140. The seals 302 and 304 are capable of preventing the spilled liquid or food from leaking through the shelf 100. In the shown embodiment, the seals 302 and 304 include gasket formed integrally with the frame 120 through co-injection molding. Alternatively, as shown in FIG. 2, the plate 140 may be prepared with a layer of seal 306, adhered to the edges of the plate 140. Materials suitable for forming the seals 302 and 304 include, but are not limited to, compressible material, such as TPE (thermoplastic elastomer) and TPO (thermoplastic olefin). Optionally, seals may be provided correspondingly for both the frame 120 and plate 140 for enhancing the sealing result.

Figure 4:
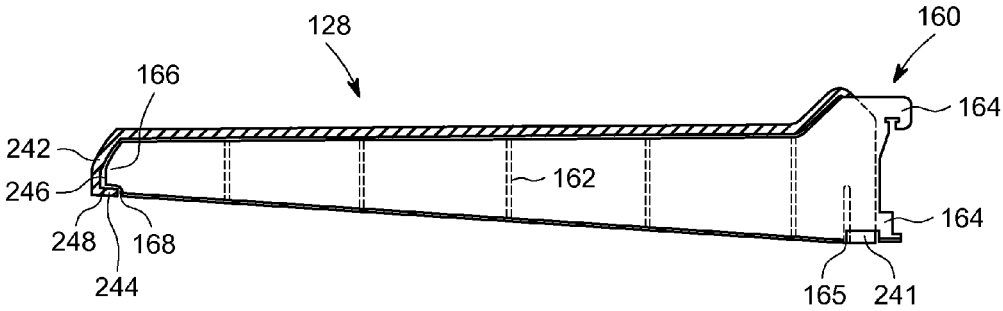
FIG. 4 is a cross section view of the shelf along Lines 4-4 in FIG. 1.

FIG. 4 is a cross section view of the shelf 100 along Lines 4-4 in FIG. 1, illustrating the engagement between the right bracket 160 and the right frame portion 128. The bracket 160 includes an elongated base portion 162 having a profile substantially complementary to that of the right frame portion 128. The elongated portion 162 extends substantially from the front side to the rear side of the frame 120.

At the rear end of the elongated base portion 162, the bracket 160 is provided with vertically spaced hooks 164. The hooks 164 are configured to engage, for example, cant tracks or liners of a refrigerator to mount the shelf 100 to the refrigerator. Adjacent to the lower hook 164, the bracket 160 further includes a recess 165 configured to engage a complementary protrusion 241 of the right frame portion 128, to provide a snap fit for mounting the bracket 160 to the frame 120.

The right frame portion 128 includes a side wall 242 and a finger 244 extending inwardly from the lower end of the side wall 242. The side wall 242 and the finger 244 together define a pocket 246. At the front end of the elongated base portion 162, the bracket 160 is provided with a protrusion 166, which extends into the pocket 246 to releasably engage an under surface 168 of the protrusion 166 with an upper surface 248 of the finger 244. The engagement between the protrusion 166 and the finger 244 at the front end of the elongated base portion 162 and the snap fit provided by the recess 165 and the protrusion 241 at the rear end of the elongated base portion 162 implement the mounting of the bracket 160 to the frame 120.

Figure 5:
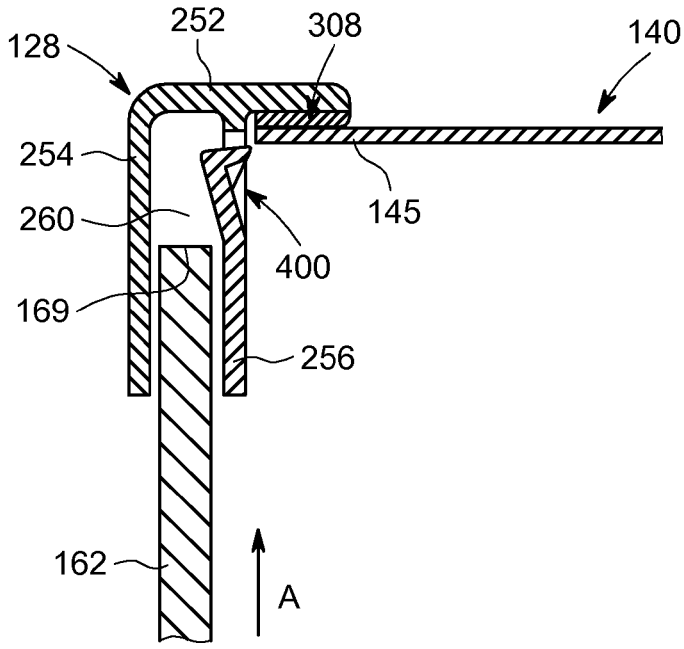
FIG. 5 is a cross section view of the shelf along Lines 5-5 in FIG. 1.

FIG. 5 is a cross section view of the shelf 100 along Lines 5-5 in FIG. 1, illustrating the locking of the plate 140 relative to the frame 120 upon the mounting of the brackets 160. The right frame portion 128 includes an upper wall 252, an outer wall 254 and an inner wall 256. The outer wall 254 and the inner wall 256 extend downwardly from the upper wall 252, and are substantially parallel to each other. The upper wall 252, outer wall 254 and inner wall 256 together define a receiving channel 260, dimensioned to allow the insertion of the elongated base portion 162 of the bracket 160 into the receiving channel 260.

The shelf 100 includes at least one pivotable tab 400 associated with the peripheral frame portion. The pivotable tab is configured to pivot upon mounting of the bracket to the frame, so as to engage at least a portion of the plate. In the shown exemplary embodiment, the pivotable tab 400 is integrally formed with the inner wall 256, and is capable of pivoting in response to engagement with a portion of base portion 162 upon the insertion of the elongated based portion 162 into the receiving channel 260. For example, the pivotable tab 400 can be molded integrally with the inner wall 256, or manufactured separated and retrofitted to the frame.

Figure 6:
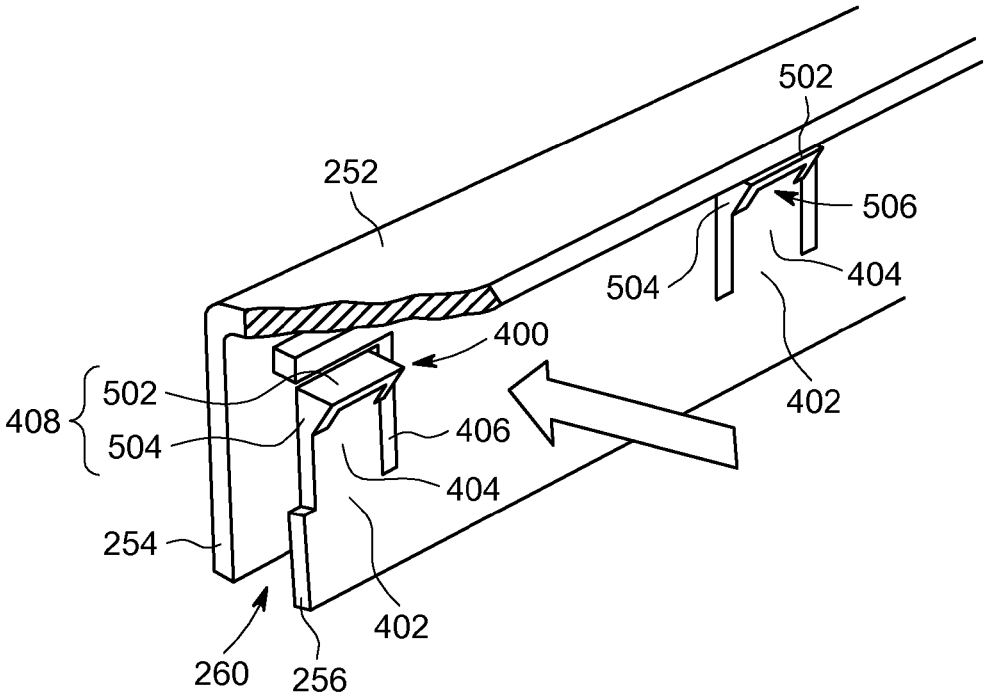
FIG. 6 is a partial perspective view of the shelf.

FIG. 6 is a partial perspective view of the right frame portion 128, illustrating pivotable tab 400 from a perspective different from that of FIG. 5. As shown, the pivotable tab 400 includes a base portion 402 coupled to the inner wall 256 and an upright portion 404 extending upwardly from the base portion 402. The upright portion 404 is substantially bordered by a continuous slot 406 carved through the inner wall 256. Due to the resilience of the material, the upright portion 404 is capable of pivoting around the base portion 402, clockwise or counter clockwise. The pivotable tab 400 further includes a terminal portion 408, disposed at the upper end of the upright portion 404, extending to the interior of the frame 120. The terminal portion 408 is configured to engage at least a portion of the plate 140 upon the mounting of the bracket 160 to the frame 120.

Referring back to FIG. 5, after the plate 140 has been carried by the front frame portion 125 and the rear frame portion 126 (as shown in FIG. 3), the elongated base portion 162 of the bracket 160 is inserted into the receiving channel 260 of the right frame portion 128 along direction A. With the advancement of the elongated base portion 162, the upper end 169 of the base portion 162 pushes the upright portion 404 of the pivotable tab 400. Consequently, the pivotable tab 400 is actuated to pivot clockwise to sandwich the right edge 145 of the plate 140 between the upper wall 252 of the right frame portion 128 and the pivotable tab 400.

Alternatively, the bracket 160 can be fastened to a side wall of the right frame portion 128 through a fastener, instead of being inserted into the receiving channel 260. For example, the elongated portion 162 of the bracket 160 can be fixed from outside to the inner wall 256 through one or more screws. The screws can be subsequently handled to apply torque or tension to the elongated portion 162 of the bracket 160, thereby at least partially deforming the elongated portion 162. Such deformation actuates the pivotable tab 400 to pivot clockwise under the right edge 145 of the plate 140. Accordingly, the right edge 145 of the plate 140 is positively retained between the between the upper wall 252 of the right frame portion 128 and the pivotable tab 400. In this case, the outer wall 254 of the right frame portion 128 can be omitted to save the material for manufacturing the frame 120 and reduce the weight of the entire shelf.

A seal 308 is provided between the right edge 145 of the plate 140 and the upper wall 252 of the right frame portion 128, for preventing spilled liquid or food from leaking through the shelf. The seal 308 can be made of a compressible material, such as a TPE or TPO. The seal 308 can be unitarily formed with the lower side of the upper wall 252 through co-injection molding, and/or provided on the upper surface of the plate 140. The seal 308 and the seals 302 and 304, in cooperation, provide a spill-proof feature for the shelf.

Referring to FIGS. 3 and 6, the terminal portion 408 includes a flat top 502 and a pair of supporting ribs 504 disposes at either side of the flat top 502. The flat top 502 engages the flat under surface of the plate 140 to compress the right edge 145 of the plate 140 against the seal 308 and the upper wall 252 of the right frame portion 128. Accordingly, the plate 140, carried at its front edge 142 and rear edge 143 by the front frame portion 125 and the rear frame portion 126, is locked in position. The pair of supporting ribs 504 and the flat top 502 define a void 506 under the flat top 502 of the pivotable tab 400. The void 506 in one aspect reduces the material used for molding the pivotable tab 400, and in another aspect provides a space for inserting a suitable tool to counter-pivot the pivotable tab 400 so as to release the plate 140.

Although the receiving channel and pivotable tab have been described in connection with the right frame portion 128 and the right edge 145, it should be understood by a person of ordinary skill in the art, that same or similar structure and configuration can be equally applied to any one of the left side, front side and rear side of the shelf. In addition, the number of tabs formed on any side of the frame can be adjusted dependent on the application circumstances of the shelf, such as the load of the food.

Figure 7:
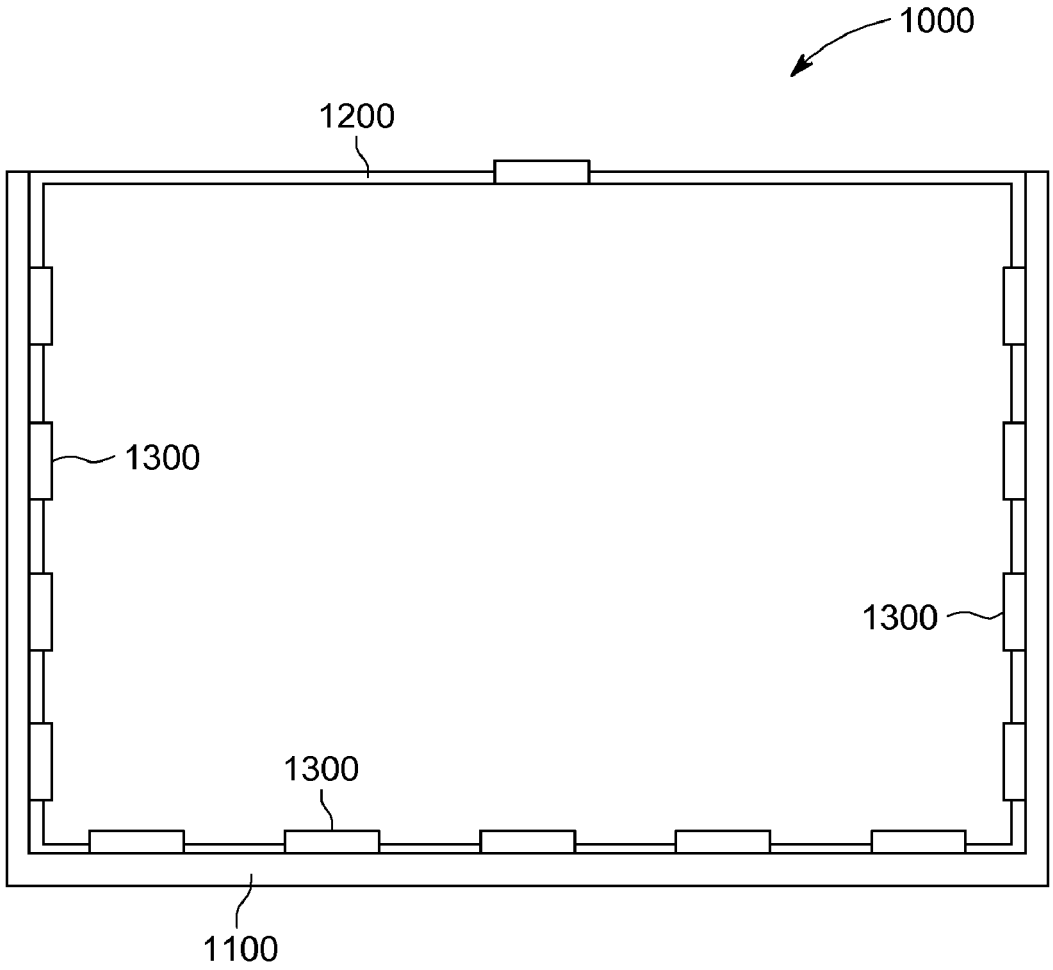
FIG. 7 is a diagram schematically illustrating a shelf according to another exemplary embodiment of the present invention.

FIG. 7 is a diagram schematically illustrating a possible variation of the exemplary embodiment shown in FIG. 1-6. In FIG. 7, a shelf 1000 includes a continuous bracket 1100 disposed continuously along the left, front and right sides of a frame 1200. The shelf 1000 further includes a plurality of pivotable tabs 1300 disposed along the left, front and right sides of a frame 1200, correspondingly. The assembling of the single bracket 1100 actuates the pivotable movement of the pivotable tabs 1300 inwardly, to securely yet releasably mount a glass pane to the frame.

Thus, while there have shown and described and pointed out fundamental novel features of the invention as applied to various specific embodiments thereof, it will be understood that various omissions and substitutions and changes in the form and details of the apparatus illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A shelf comprising:

a frame having a peripheral frame portion for defining a central opening;

a plate supported by the peripheral frame portion, for providing a containment region in cooperation with the central opening;

at least one bracket mountable to the frame; and at least one pivotable tab associated with the peripheral frame portion, wherein the at least one pivotable tab comprises:

a base portion; and an upright portion extending from the base portion, wherein the upright portion is configured to pivot around the base portion and to engage at least a portion of the plate upon mounting of the at least one bracket to the frame.

2. The shelf of claim 1, wherein the peripheral frame portion comprises substantially parallel front and rear frame portions and substantially parallel left and right frame portions.

3. The shelf of claim 2, wherein the plate comprises substantially parallel front and rear edges retained by the front and rear frame portions, respectively, and substantially parallel left and right edges retained by the left and right frame portions, respectively.

4. The shelf of claim 3, wherein the front frame portion comprises a slot for receiving the front edge of the plate.

5. The shelf of claim 4, wherein the rear frame portion comprises an abutment for carrying the rear edge of the plate.

6. The shelf of claim 3, wherein at least one of the left and right frame portions comprises an upper wall and a side wall depending from the upper wall, the at least one bracket being fixed to the side wall through at least one fastener.

7. The shelf of claim 6, wherein the base portion is coupled to the side wall, and wherein the upright portion is substantially bordered by a continuous slot formed through the side wall and is configured to pivot around the base portion upon the fixation of the at least one bracket to the side wall.

8. The shelf of claim 7, wherein the upright portion comprises a terminal portion configured to engage the at least a portion of the plate.

9. The shelf of claim 8, wherein the terminal portion comprises a flat top and a pair of supporting ribs, the flat top and the supporting ribs defining a void.

10. The shelf of claim 3, wherein at least one of the left and right frame portions comprises an upper wall, an outer wall and an inner wall, the outer wall and the inner wall extending from the upper wall and opposite to each other, the upper wall, outer wall and inner wall defining a receiving channel allowing insertion of the at least one bracket therein.

11. The shelf of claim 10, wherein the base portion is coupled to the inner wall, and wherein the upright portion is substantially bordered by a continuous slot formed through the inner wall and is configured to pivot around the base portion upon the insertion of the at least one bracket into the receiving channel.

12. The shelf of claim 11, wherein the upright portion comprises a terminal portion configured to engage the at least a portion of the plate.

13. The shelf of claim 12, wherein the terminal portion comprises a flat top and a pair of supporting ribs, the flat top and the supporting ribs defining a void.

14. The shelf of claim 1, further comprising at least one seal disposed between the frame and the plate.

15. A refrigerator comprising:

at least one storing compartment; and at least one shelf disposed in the compartment, comprising:

a frame having a peripheral frame portion for defining a central opening;

a plate supported by the peripheral frame portion, for providing a containment region in cooperation with the central opening;

at least one bracket mountable to the frame; and at least one pivotable tab associated with the peripheral frame portion, wherein the at least one pivotable tab comprises:

a base portion: and an upright portion extending from the base portion, wherein the upright portion is configured to pivot around the base portion and to engage at least a portion of the plate upon mounting of the at least one bracket to the frame.

16. The refrigerator of claim 15, wherein the peripheral frame portion comprises substantially parallel front and rear frame portions and substantially parallel left and right frame portions.

17. The refrigerator of claim 16, wherein the plate comprises substantially parallel front and rear edges retained by the front and rear frame portions, respectively, and substantially parallel left and right edges retained by the left and right frame portions, respectively.

18. The refrigerator of claim 17, wherein the front frame portion comprises a slot for receiving the front edge of the plate.

19. The refrigerator of claim 18, wherein the rear frame portion comprises an abutment for carrying the rear edge of the plate.

20. The refrigerator of claim 17, wherein at least one of the left and right frame portions comprises an upper wall and a side wall depending from the upper wall, the at least one bracket being fixed to the side wall through at least one fastener.

21. The refrigerator of claim 20, wherein the base portion is coupled to the side wall, and wherein the upright portion is substantially bordered by a continuous slot formed through the side wall and is configured to pivot around the base portion upon the fixation of the at least one bracket to the side wall.

22. The refrigerator of claim 21, wherein the upright portion comprises a terminal portion configured to engage the at least a portion of the plate.

23. The refrigerator of claim 22, wherein the terminal portion comprises a flat top and a pair of supporting ribs, the flat top and the supporting ribs defining a void.

24. The refrigerator of claim 17, wherein at least one of the left and right frame portions comprises an upper wall, an outer wall and an inner wall, the outer wall and the inner wall extending from the upper wall and opposite to each other, the upper wall, outer wall and inner wall defining a receiving channel allowing insertion of the at least one bracket therein.

25. The refrigerator of claim 24, the base portion is coupled to the inner wall, and wherein the upright portion is substantially bordered by a continuous slot formed through the inner wall and is configured to pivot around the base portion upon the insertion of the at least one bracket into the receiving channel.

26. The refrigerator of claim 25, wherein the upright portion comprises a terminal portion configured to engage the at least portion of the plate.

27. The refrigerator of claim 26, wherein the terminal portion comprises a flat top and a pair of supporting ribs, the flat top and the supporting ribs defining a void.

28. The refrigerator of claim 15, further comprising at least one seal disposed between the frame and the plate.

29. A shelf comprising:

a frame having a peripheral frame portion for defining a central opening;

a plate supported by the peripheral frame portion, for providing a containment region in cooperation with the central opening;

at least one bracket mountable to the frame; and at least one pivotable tab integrally formed with the peripheral frame portion, the pivotable tab configured to engage at least a portion of the plate upon mounting of the at least one bracket to the frame.

* * * * *